US005243330A

United States Patent [19]

Thuillard

[11] Patent Number: 5,243,330

[45] Date of Patent: Sep. 7, 1993

[54] FIRE DETECTOR SYSTEM AND METHOD

[75] Inventor: Marc Thuillard, Mannedorf, Switzerland

[73] Assignee: Cerberus AG, Mannedorf, Switzerland

[21] Appl. No.: 801,538

[22] Filed: Dec. 2, 1991

[30] Foreign Application Priority Data

Dec. 4, 1990 [CH] Switzerland ..... 3822/90

[51] Int. Cl.[5] ..... G08B 17/10

[52] U.S. Cl. ..... 340/629; 250/381; 340/511; 340/661

[58] Field of Search ..... 340/579, 629, 587, 511, 340/522, 661; 250/389, 384, 381, 281, 489, 492.3, 423 R, 397; 324/722

[56] References Cited

U.S. PATENT DOCUMENTS

| | | | |
|---|---|---|---|
| 3,866,195 | 2/1975 | Ried, Jr. | 340/629 |
| 3,964,036 | 6/1976 | Adachi et al. | 340/514 |
| 4,041,479 | 8/1977 | Miyabe | 340/629 |
| 4,288,694 | 9/1981 | Ahrons | 250/374 |
| 4,300,133 | 11/1981 | Solomon | 340/630 |
| 4,364,031 | 12/1982 | Scheidweiler et al. | 340/629 |
| 4,401,978 | 8/1983 | Solomon | 340/629 X |
| 4,455,553 | 6/1984 | Johnson | 340/629 |
| 4,459,583 | 7/1984 | van der Walt et al. | 340/629 X |

FOREIGN PATENT DOCUMENTS

| | | |
|---|---|---|
| 0070449 | 7/1982 | European Pat. Off. . |
| 0384209 | 2/1990 | European Pat. Off. . |
| 1101370 | 9/1961 | Fed. Rep. of Germany . |
| 2415479 | 11/1974 | Fed. Rep. of Germany . |
| 2428325 | 1/1975 | Fed. Rep. of Germany . |
| 2423046 | 3/1975 | Fed. Rep. of Germany . |
| 2537598 | 3/1976 | Fed. Rep. of Germany . |

OTHER PUBLICATIONS

Abstract of Japanese Appln. No. 47-93018; title—Ionization Smoke Detector. Published May 1974.

*Primary Examiner*—Thomas Mullen

*Attorney, Agent, or Firm*—Brumbaugh, Graves, Donohue & Raymond

[57] ABSTRACT

A fire detector system including ionization smoke detectors (7) is provided with improved false-alarm protection. The system includes an ionization chamber (1) with a radioactive source (10), connected in series with a resistor (2) between power supply lines (8, 9), and circuitry (11, 28) for switching the operating voltage of the ionization chamber between a normal operating value (Ut) chosen for maximized detector sensitivity, and an elevated value (Uh) for operation at current saturation. Comparisons involving the ionization currents through the ionization chamber at the two operating voltages are used not only to recognize a condition of partial shielding of the radio-active source (due to condensation, for example), but also to detect smoke under such conditions.

11 Claims, 2 Drawing Sheets

FIRE DETECTOR SYSTEM AND METHOD

BACKGROUND OF THE INVENTION

This invention relates to fire detector systems including ionization smoke detectors capable of assuming different electrical states, which are connected by signal lines to control and indicating means.

Fire detector systems are finding increasing use for the protection of human life and of valuables; they include fire detectors located with objects to be protected, and control and indicating equipment connected to the detectors via communication means. Distinguished among fire detectors are ionization smoke detectors, as these are capable of detecting a fire at a sufficiently early stage to allow timely deployment of suitable fire-fighting means, especially for the protection of human life. Such systems may be designated as early-warning systems.

The operation of ionization smoke detectors is based on the presence of smoke or aerosols affecting the ionic current flowing in an ionization chamber. In such a detector, ambient air entering a measurement chamber is ionized by a weakly radioactive source, thereby permitting an ionic current to flow between electrodes. If smoke or, more generally speaking, a combustion aerosol enters the measurement chamber, atmospheric ions are adsorbed onto the aerosol particles, thereby significantly reducing their mobility. As a result, the ionic current is decreased. If the change in current exceeds a certain critical value, an alarm signal is produced and transmitted to control and indicating means.

With fire detector systems there is a concern with false alarms. In the case of ionization smoke detectors, there is particular concern with the sensitivity of detectors to fast air currents, to condensation, or to shielding of the radioactive source by dust or corrosion, as these phenomena have an influence on the ionic current similar to the presence of combustion aerosols. Since the attendant change of the ionic current results in increased detector sensitivity, the tendency to false alarms is increased also. False alarms are of particular concern when an alarm signal causes the activation of automatic fire extinguishing means or the mobilization of external fire-fighting forces.

For the prevention of false alarms due to fast air currents, suitable designs have been developed for the air inlet openings, e.g., in accordance with published German Patent Document DE-B2-2415479. To prevent malfunctioning of ionization smoke detectors due to condensation the electrodes may be heated. As disclosed in published German Patent Document DE-B2-2537598, this may involve the use of heat as inevitably produced by the electronic circuitry.

Published European Patent Document EP-A1-0070449 discloses evaluation of measurement data after their transmission to control and indicating means. This involves forming a quiescent value based on individual detector measurements, and storing the quiescent value in a quiescent-value memory. Based on a measured actual value and a comparison value stored in a comparison memory, an updated comparison value is computed and stored in the comparison memory. Depending upon the outcome of a comparison between the updated comparison value and a threshold value, either (i) indicating equipment is activated or else (ii) an updated quiescent value is formed based on the measured actual value and the previously stored quiescent value, and the updated quiescent value is stored in the quiescent-value memory. In this fashion it is possible to compensate for slow changes in the detector, e.g., due to soiling, and to maintain stable detector sensitivity over extended time periods.

Published German Patent Document DE-A1-2428325 discloses the choice of a condensation-inhibiting chemical composition for the plate separating the measurement chamber from the reference chamber, to prevent condensation and attendant deterioration of the electrical insulation of the ionization measurement chamber.

For the prevention of false alarms due to shielding of the radioactive source by soiling, published Japanese Patent Document JP-PA-47-93018 discloses proportioning of the leakage paths between an intermediate electrode and two outer electrodes in correspondence with the ratio between chamber voltages, so that, in the case of uniform soiling, no voltage shift occurs at the intermediate electrode.

For the prevention of precipitation on the radioactive source as would impair the operational performance of an ionization smoke detector, published German Patent Document DE-PS-1101370 discloses the inclusion of an electrically biased annular guard electrode facing a conductive support of the radioactive source. The resulting electrical field is intended for preventing precipitates from forming on the radioactive source.

Published German Patent Document DE-B2-2423046 discloses a system of annular guard rings for detecting reduced insulation resistance of the ionization measurement chamber as may result from condensation or dust accumulation. A change in the potential difference between the guard-ring system and the connection between measurement and reference chambers is taken by control and indicating means as a problem indicator.

U.S. Pat. No. 3,964,036, issued Jun. 15, 1976 to Y. Adachi et al. discloses a fire detector system including first and second ionization chambers, one serving as measurement ionization chamber for the detection of smoke, and the other serving as reference chamber. These chambers are connected in series between signal lines which also serve as electrical power supply lines to the detector. An amplifier element is connected to the electrode common to measurement and reference chambers, to produce an amplified signal corresponding to the voltage at the common electrode. The course of the amplified signal of the ionization smoke detector is shown on a display screen and recorded by a plotter. A false alarm is distinguished from a genuine alarm on the basis of a comparison of the shape of the signal so obtained with curves known to be due to soiling or condensation. This method of diagnosing false alarms is expensive, technologically as well as with respect to personnel needed.

To overcome the drawbacks of the described fire detector systems, a method disclosed in published European Patent Document EP-A2-0384209 provides for operation of an ionization smoke detector as follows: The ionization smoke detector includes an ionization measurement chamber in which ambient air is ionized by a radioactive source. Included in the ionization measurement chamber is a first electrode to which a direct-current supply voltage is applied, and a measurement electrode whose electrical potential changes as a function of the concentration of aerosols upon admission of smoke into the measurement chamber. Monitoring of this electrical potential is used for the production of a smoke alarm signal. When, under application of the supply voltage to the first electrode, the electrical potential at the measurement electrode reaches a predetermined first reference value, a second voltage is temporarily applied to the first electrode. The electrical potential at the measurement electrode is now compared with at least one second reference value, and a smoke alarm signal is produced when the electrical potential at the measurement electrode has at least approximately reached the second reference value. The second reference value may be determined based on the law of small-ion adsorption, and on measurements and/or calculations corresponding to smoke-free or essentially smoke-free conditions.

The described detector system provides for immediate and automatic discrimination as to whether a change in the ionic current in the ionization measurement chamber is spurious, or whether it represents a genuine alarm caused by fire. However, this fire detector system does not provide for the detection of smoke when ionization has been reduced by condensation on the radioactive source. More specifically, when the ionic current is reduced simultaneously or previously due to shielding of the radioactive source, e.g., by condensation, the described smoke detector system is unable to detect smoke invasion.

SUMMARY OF THE INVENTION

For the reliable detection of smoke even when a radioactive source is partially shielded or obstructed, e.g., due to condensation, means are included in a fire detector system for providing first (lower) and second (higher) operating voltages of an ionization smoke detector. In terms of corresponding first and second normalized amplified detector output signals, i.e., signals which are directly related to current strength in an ionization measurement chamber and which are normalized to have unit value in the absence of smoke in the ionization chamber and of obstructing precipitation on the radioactive source, an alarm signal is produced when the first normalized signal simultaneously is less than the second normalized signal and less than an alarm threshold.

When the first normalized signal is greater than the second normalized signal but less than a monitoring threshold, a trouble signal may be produced to indicate shielding of the radioactive source.

DETAILED DESCRIPTION OF PREFERRED EMBODIMENTS

Figure 1:
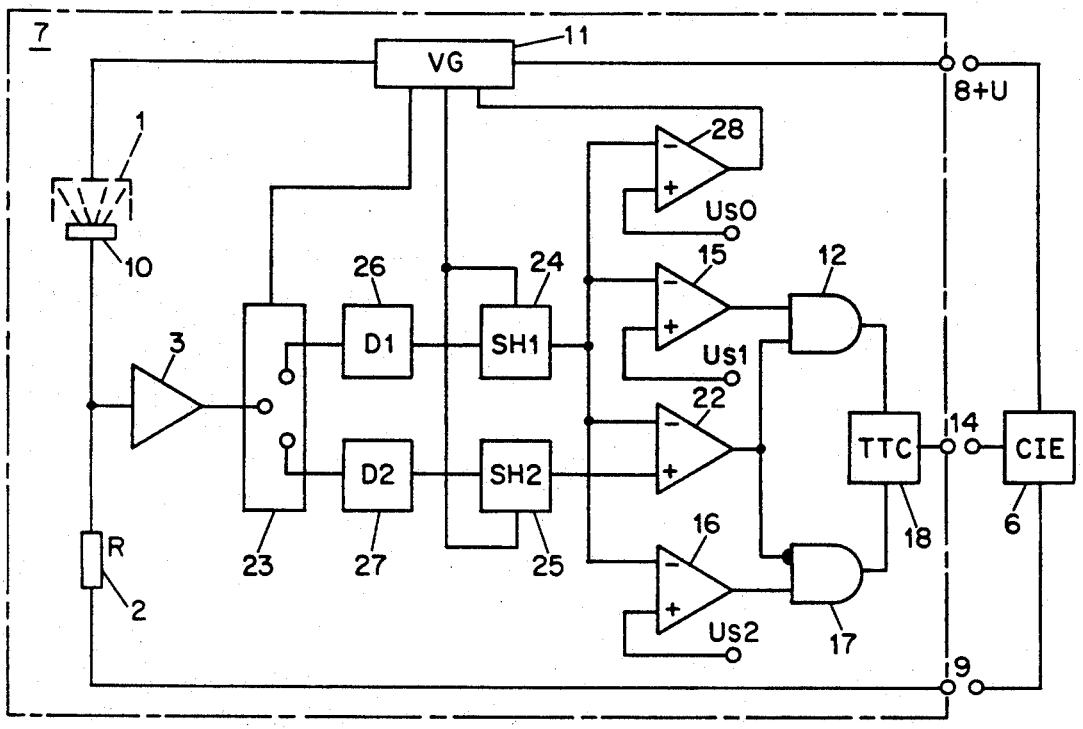
FIG. 1 is a circuit block diagram of a fire detector system in accordance with a preferred embodiment of the present invention.

In a preferred embodiment of a fire detector system, shown in FIG. 1, a preferred ionization smoke detector 7 includes an ionization measurement chamber 1 with smoke inlet openings for admitting ambient air to the measurement chamber 1. Disposed in the measurement chamber 1 is a radioactive source 10 for ionizing the air inside the chamber 1. The ionization measurement chamber 1 is connected between signal lines 8 and 9 (which advantageously also serve as voltage supply lines), in series with a high-ohmic load resistor 2 having linear current/voltage characteristics. An amplifier element 3 is attached to the connection between the ionization measurement chamber 1 and the load resistor 2.

A voltage generator 11 is connected to the signal line 8, providing for switching of the operating voltage of the ionization smoke detector 7 between two values Ut and Uh. The lower voltage, Ut, is chosen such that the ionization measurement chamber 1 operates in a region of high sensitivity to smoke; the higher voltage, Uh, is chosen such that the ionization measurement chamber 1 operates in (or at least sufficiently near) a saturation region. Suitable values for these voltages are Ut=4 volts and Uh=20 volts, for example.

Unlike the fire detector system disclosed in published European Patent Document EP-A2-0384209, the present preferred smoke detector system includes a commutator 23 which is connected to the output terminal of the amplifier element 3, for alternately connecting the output signal of the amplifier element 3 with a first divider 26 or a second divider 27. The first divider 26 provides for division of the output signal of the amplifier element 3 by a constant value, Ua, set in advance (e.g., at the factory). This value Ua corresponds to the normal quiescent-state output signal of the amplifier element 3, at the normal operating voltage, Ut. Accordingly, under normal conditions, the output signal of the first divider 26 is equal to one. The second divider 27 provides for division of the output signal of the amplifier element 3 by another constant value, Ub, which is also set in advance, and which corresponds to the regular, quiescent-state output signal of the amplifier element 3 at the higher operating voltage, Uh. In the following, the values resulting from these divisions will be designated as "normalized values".

The output terminals of the dividers 26 and 27 are connected to respective first and second sample and hold circuits 24 and 25 in which the output signals of the amplifier element 3, divided in the divider 26 or 27 by a respective constant value to result in a normalized value, are stored until, upon switching, a respective new value is supplied to the corresponding sample and hold circuit 24 or 25.

In synchrony with the switching of the operating voltage between the values Ut and Uh, the voltage generator 11 controls the commutator 23 such that, when the voltage Ut is applied, the output terminal of the amplifier element 3 is connected to the first divider 26 and to the first sample and hold circuit 24, and, when the voltage Uh is applied, the output terminal of the amplifier element 3 is connected to the second divider 27 and the second sample and hold circuit 25. The output terminal of the first sample and hold circuit 24 (corresponding to the lower voltage, Ut) is connected to the negative input terminals of first and second comparators 15 and 16, as well as to the negative input terminals of third and fourth comparators 22 and 28. A voltage Us1 is applied to the positive input terminal of the first comparator 15, representing the alarm threshold of the ionization smoke detector 7, and a voltage Us2 is applied to the positive input terminal of the second comparator 16, representing the monitoring threshold of the ionization smoke detector 7. One input terminal of the third comparator 22 is connected to the output terminal of the first sample and hold circuit 24; the other input terminal of the third comparator 22 is connected to the output terminal of the second sample and hold circuit 25. Thus, the third comparator 22 serves for the mutual comparison of the two normalized output signals of the amplifier element 3. The output terminal of the third comparator 22 is connected to a first AND-gate 12 as well as to an inverting input terminal of a second AND-gate 17 whose other, noninverting input terminal is connected to the output terminal of the second comparator 16. The output terminals of the AND-gates 12 and 17 are connected to a trouble-signal transmission circuit 18 whose output signal is transmitted to the control and indicating equipment 6 by an additional signal line 14.

The fourth comparator 28 serves to compare the normalized output signals of the amplifier element 3 with the voltage Us0. The value of Us0 is greater than the alarm threshold Us1 and greater than the monitoring threshold Us2; it represents the normalized output signal of the amplifier element 3 at which the voltage generator 11 begins to switch the operating voltage on the signal line 8. If the value of the normalized output signal of the amplifier element 3 is greater than the voltage Us0, the output at the fourth comparator 28 corresponds to a logical ZERO. The voltage generator 11 is designed such that, in this case, a constant voltage Ut is produced. If the value of the normalized output signal of the amplifier element 3 at the lower voltage Ut is less than Us0, the output at the fourth comparator 28 corresponds to a logical ONE. This signal is transmitted to the voltage generator 11 to initiate periodic switching of the operating voltage U+ on the signal line 8 between lower and higher voltages Ut and Uh. The voltage generator 11 also controls the commutator 23, so that the output signal of the amplifier element 3 is synchronously and alternately transmitted to the first divider 26 (at the lower voltage, Ut) or to the second divider 27 (at the higher voltage, Uh).

In its normal state, the voltage generator 11 produces an output voltage Ut which determines the operating point of the measurement chamber 1. The value Ut is chosen for the measurement chamber 1 to operate in a region of high sensitivity to smoke. The measurement-chamber current produces a voltage drop U0 across the load resistor 2. As the voltage generator 11 produces the voltage Ut, the output of the amplifier element 3 is connected to the first divider 26 in which the signal value is divided by the constant value Ua. The resulting normalized signal is applied to the negative input terminals of the comparators 15, 16, 22, and 28. Since the signal is greater than the voltage Us0, the voltage on the signalling line 8 remains at the value Ut, and, via the commutator 23, the output terminal of the amplifier element 3 remains connected to the first divider 26. Since the normalized signal appearing at the output terminal of the first sample and hold circuit 24 is above the alarm threshold Us1 as well as above the monitoring threshold Us2, the output signals at both comparators 15 and 16 are ZERO. As a result, the outputs of both AND-gates 12 and 17 are ZERO also, and neither an alarm nor a trouble indicator signal is transmitted to the control and indicating equipment 6.

When the ionic current in the ionization measurement chamber 1 changes, the output signal of the amplifier element 3 changes accordingly. In the case of decreasing ionic current, the output signal of the amplifier element 3 also decreases. If the normalized output signal of the amplifier element 3 decreases to the point where the fourth comparator 28 switches to the logical state ONE, the voltage generator 11 switches to the second mode of operation, i.e., it periodically switches the voltage on the signalling line 8 between the lower (normal) value Ut and the higher value Uh. Preferred switching frequencies are in a range of approximately 0.25 to 1 Hz. Synchronously, the commutator 23 is activated, so that the output terminal of the amplifier element 3 alternately is connected to one or the other of the dividers 26 and 27. The normalized output signals are produced at the output terminals of the sample and hold circuits 24 and 25 and are compared with each other by the third comparator 22.

Figure 3A:
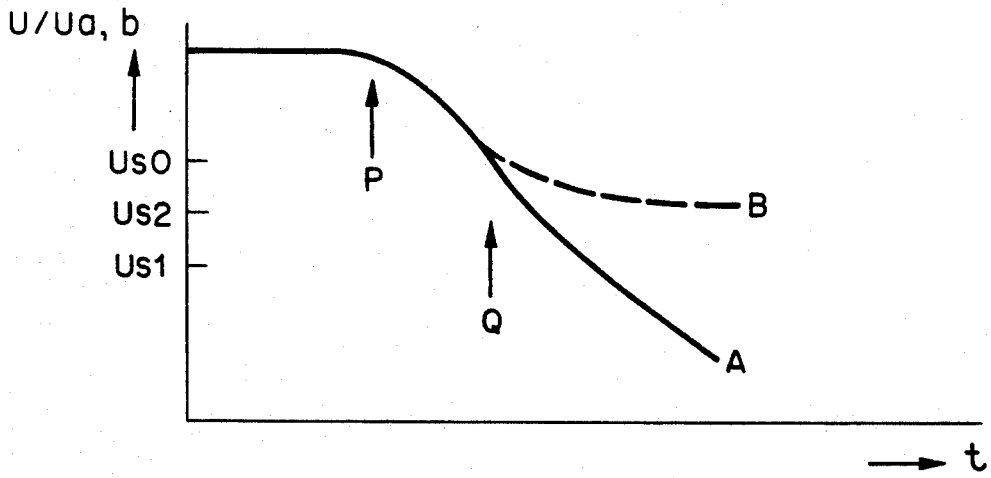
FIG. 3*a* through 3*c* are graphic representations of output signals of an amplifier element as a function of time for different ionic currents in a preferred embodiment of the invention.
Figure 3B:
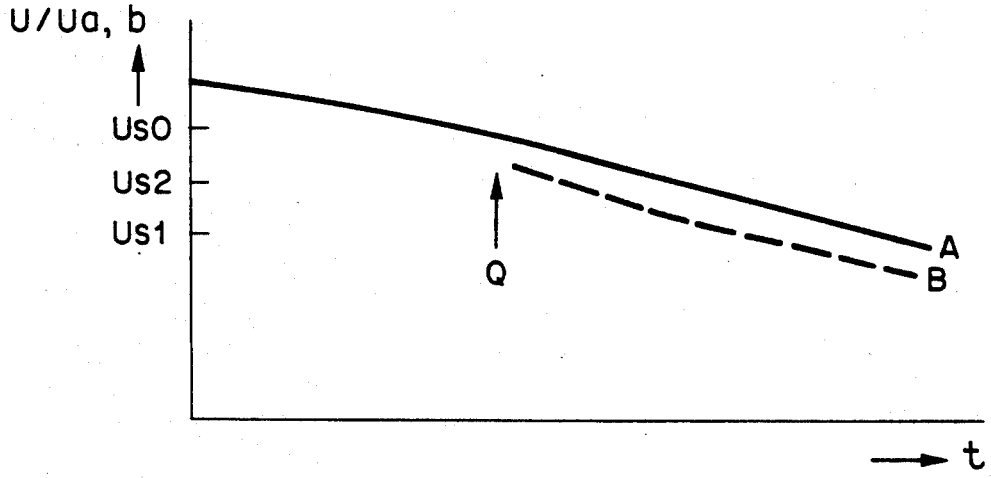
Figure 3C:
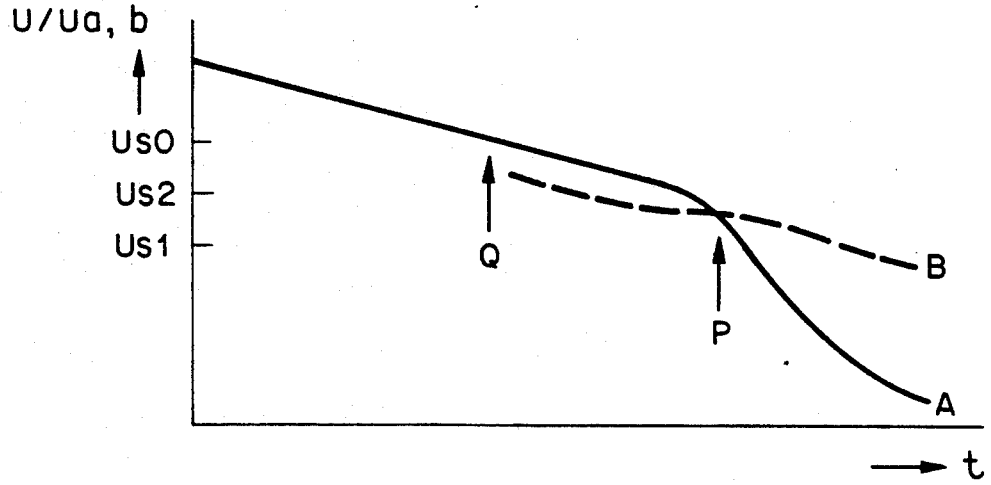

The operation of a preferred fire detector system may be described further with reference to FIG. 3*a* through 3*c* in which normalized output voltages U/Ua or U/Ub of the amplifier element 3 are plotted as ordinates versus abscissa values of time. The solid line represents the normalized output voltage U/Ua of the amplifier element for the low operating voltage Ut, and the broken line represents the output voltage U/Ub of the amplifier element 3 for the high operating voltage Uh. The following three important cases will be discussed further with reference to FIG. 3:

1. Smoke enters the detector, while the radio-active source 10 remains unobstructed (smoke detection under normal detector conditions).

2. No smoke has entered the ionization measurement chamber, but there is condensation on the radioactive source 10 to such an extent as to resemble an alarm (false-alarm or detector trouble condition).

3. There is condensation on the radioactive source 10 sufficient to result in a trouble condition; also, simultaneously, smoke is entering the ionization measurement chamber (smoke detection under conditions of shielding of the radioactive source).

Case 1: Normal Fire Alarm. It is assumed that the fire detector is in a normal operational state, i.e., there has been no shielding of the radioactive source 10. Thus, the normalized output signal, U/Ua of the amplifier element 3 is equal to 1 (FIG. 3*a*, to the left of Point P). If a combustion aerosol (smoke) now enters the ionization measurement chamber 1 (Point P), the ionic current in the ionization measurement chamber 1 decreases, and the normalized output signal of the amplifier element 3 decreases correspondingly, until the switching threshold value Us0 is reached (FIG. 3*a*, Point Q). At this point, the fourth comparator 28 switches to logical ONE, and the voltage generator 11 changes to its second operating mode, i.e., the operating voltage is being switched back and forth between the lower value Ut and the higher value Uh. The normalized output signals from the amplifier element 3, measured at the lower operating voltage Ut and appearing at the first sample and hold circuit 24 are as shown in FIG. 3*a*, Curve A, and those measured at the higher operating voltage Uh and appearing at the second sample and hold circuit 25 are as shown in FIG. 3*a*, Curve B. Since the former are less than the latter, the logical state of the third comparator 22 is ONE. If the signal at the first sample and hold circuit 24 now further falls below the alarm threshold Us1, the logical state of the first comparator 15 is ONE also; as a result, the logical state of the first AND-gate 12 is ONE, and an alarm signal will be transmitted to the control and indicating equipment 6.

Case 2: Condensation on the Radioactive Source 10, No Smoke (Trouble Condition). Here it is assumed that the radioactive source 10 of the ionization measurement chamber 1 is shielded to some extent, e.g., due to condensation. The ionic current in the ionization measurement chamber 1 is decreased due to lowered ionization of the atmospheric molecules in the chamber. When the normalized output signal of the amplifier element 3 falls below the switching threshold Us0 (FIG. 3*b*, Point Q), the voltage generator 11 begins to switch the operating voltage back and forth between the normal and increased levels. In contrast to Case 1, in this case the normalized output signal of the amplifier element 3, appearing at the first sample and hold circuit 24 (lower supply voltage, Ut) is greater than the corresponding signal at the elevated supply voltage Uh; thus, the logical state of the third comparator 22 is ZERO. Independent of the logical state of the first comparator 15, the logical state of the first AND-gate 12 is ZERO, so that no alarm signal is transmitted to the control and indicating equipment 6. If, simultaneously, the normalized output signal of the amplifier element 3 falls below the value of the monitoring threshold Us2, the second comparator 16 assumes the logical state ONE. As the output of the third comparator 22 is inverted at the input to the second AND-gate 17, the latter also assumes the logical state ONE, and a trouble indicator signal is transmitted to the control and indicating equipment 6.

Case 3: Detection of Smoke in the Presence of Condensation. In this case the operation of the ionization smoke detector 7 is impaired due to shielding (condensation) of the radioactive source 10 in the ionization measurement chamber 1, and then smoke enters the ionization measurement chamber 1. Due to reduced ionic current in the ionization measurement chamber 1, the normalized output signal of the amplifier element 3 is reduced to the point where it falls below the value Us0 (FIG. 3*c*, Point Q). Thus, at this point the fourth comparator 28 assumes the logical state ONE, and the voltage generator 11 switches to its second mode of operation in which the operating voltage alternates between the lower value Ut and the higher value Uh (FIG. 3*c*, between Points Q and P). As in Case 2, when the normalized output signal of the amplifier element 3 falls below the value of the monitoring threshold Us2, a trouble indicator signal is produced.

If a combustion aerosol (smoke) now enters the ionization chamber 1 (FIG. 3*c*, Point P), the ionization current in the ionization measurement chamber 1 is reduced further, but the normalized output signal of the amplifier element 3 is reduced to a greater extent at the normal supply voltage Ut as compared with the normalized output signal of the amplifier element 3 at the elevated supply voltage Uh. As a result, the ratios of the values of the normalized output signals of the amplifier element 3 which appear at the respective sample and hold circuits 24 and 25 are reversed: the values which appear at the first sample and hold circuit 24, i.e., those measured at the lower supply voltage Ut, are less than those measured at the higher supply voltage Uh and appearing at the second sample and hold circuit 25. Thus, the logical state of the third comparator 22 is ONE. Once the signal at the first sample and hold circuit 24 falls below the alarm threshold Us1, the logical state of the first comparator 15 turns to ONE also; as a result, the logical state of the first AND-gate 12 is ONE, and an alarm signal is transmitted to the control and indicating equipment 6 even though the operation of the ionization detector 7 was impaired due to condensation, and in addition to the generation of a trouble indicator signal.

In a preferred alternate embodiment, means for the comparison of signals may be placed with control and indicating equipment 6. In this case the ionization smoke detector 7 advantageously includes suitable transmission circuitry for transmitting to the control and indicating equipment the voltage across the load resistor 2 amplified by the amplifier element 3. Transmission may be in analog or digital form. In preferred further embodiments, switching of the operating voltage may be effected by the control and indicating equipment 6, or may be triggered in the ionization smoke detector 7 by a signal from the control and indicating equipment 6.

Figure 2:
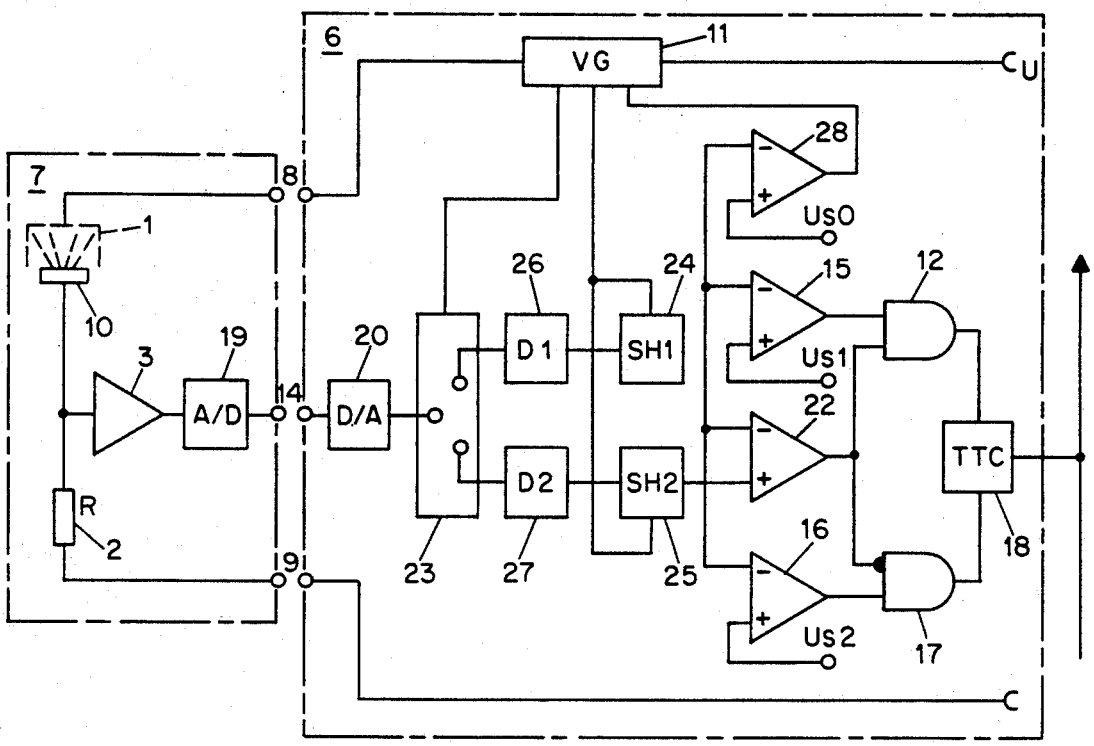
FIG. 2 is a circuit diagram of a preferred further embodiment of the invention.

FIG. 2 shows a fire detector system in accordance with a preferred further embodiment of the present invention, in which an ionization smoke detector 7 (as in the case of the embodiment in accordance with FIG. 1) includes an ionization measurement chamber 1 with smoke inlet openings for admitting ambient air into the measurement chamber 1. The measurement chamber 1 contains a radioactive source 10 for the ionization of the air inside the measurement chamber 1. The ionization measurement chamber 1 is connected in series with a high-ohmic load resistor 2 between two signalling lines 8 and 9 which also serve as voltage supply lines. An amplifier element 3 is attached to the connection between the ionization measurement chamber 1 and the load resistor 2. In this case, however, the output terminal of the amplifier element 3 is connected to an analog-to-digital converter 19, and an analog signal appearing as output from the amplifier element 3 is transmitted in digital form to control and indicating equipment 6 via an additional signalling line 14. In the control and indicating equipment 6, the digital signal is converted back to analog form by a digital-to-analog converter 20 and transmitted to a commutator 23 as in the embodiment in accordance with FIG. 1. Further signal processing may then correspond to processing described above with reference to FIG. 1. Here, the voltage generator 11 is situated with the control and indicating equipment 6.

Further modifications of the above-described circuitry for fire detector systems may be made within the scope of the claims, as familiar to those skilled in the art.

I claim:

1. A fire detector system including an ionization smoke detector (7) connected to control and indicating means (6) and comprising an ionization measurement chamber (1) for producing an output signal as a function of the concentration of combustion aerosols in air entering the ionization measurement chamber, connected in series with a load resistor (2) between first and second voltage supply lines (8, 9), a radioactive source (10) for ionizing air within the ionization measurement chamber, an amplifier element (3) for amplifying the output signal of the ionization measurement chamber to produce an amplified signal which is directly related to an ionic current strength in the ionization measurement chamber, a voltage generator (11) for supplying to the ionization smoke detector a first operating voltage (Ut) and a second operating voltage (Uh) which is greater than the first operating voltage, and evaluation means (12, 15, 16, 17, 18, 22) for producing an alarm signal to the control and indicating means to indicate a critical concentration of combustion aerosols in the ionization measurement chamber, comprising comparator means (15, 16, 22) for evaluating first and second amplified signals from the ionization measurement chamber at the first and second respective operating voltages, and adapted to produce the alarm signal when the first amplified signal divided by a predetermined first quiescent-state voltage (Ua) is less than an alarm threshold (Us1), and the first amplified signal divided by the first quiescent-state voltage is less than the second amplified signal divided by a predetermined second quiescent-state voltage (Ub).

2. The first detector of claim 1, wherein the voltage generator is adapted to alternate between supplying the first and second operating voltages.

3. The fire detector system of claim 2, the voltage generator being disposed with the ionization smoke detector.

4. The fire detector system of claim 2, the voltage generator being disposed with the control and indicating means.

5. The fire detector system of claim 2, comprising a commutator (23) connected to the amplifier element, to the voltage generator, and to first (26) and second (27) dividers for producing normalized signals by division by respective first and second quiescent-state voltages, the commutator being adapted to transmit an amplified signal either to the first or to the second divider such that amplified signals produced at the first and the second operating voltages are transmitted to the respective first or second divider.

6. The fire detector system of claim 5, comprising first (24) and second (25) sample and hold memories for storing the normalized signals, connected to the respective first and second dividers.

7. The fire detector system of claim 1, comprising means for producing a trouble signal when the first amplified signal divided by the first quiescent-state voltage is greater than the second amplified signal divided by the second quiescent-state voltage, and less than a monitoring threshold value (Us2).

8. The fire detector system of claim 7, wherein the evaluation means comprises first (24) and second (25) sample and hold memories, first (15), second (16) and third (22) comparators, and first (12) and second (17) AND-gates, a negative input terminal of the first comparator being connected to an output terminal of the first sample and hold memory, a positive input terminal of the first comparator being connected to a voltage source for supplying an alarm threshold voltage, an output terminal of the first sample and hold memory being connected to a first input terminal of the third comparator, an output terminal of the second sample and hold memory being connected to a second input terminal of the third comparator, a negative input terminal of the second comparator being connected to the output terminal of the first sample and hold memory, a positive input terminal of the second comparator being connected to a voltage source for supplying the monitoring threshold voltage, an output terminal of the first comparator being connected to a first input terminal of the first AND-gate, an output terminal of the third comparator being connected to a second input terminal of the first AND-gate and to an inverting input terminal of the second AND-gate, and an output terminal of the second comparator being connected to a noninverting input terminal of the second AND-gate.

9. The fire detector system of claim 1, comprising first and second transmission means (19, 20) with the ionization smoke detector and with the control and indicating means, for transmitting an output signal of the amplifier means to the control and indicating means, and the evaluation means being included with the control and indicating means.

10. A method for fire detection, comprising applying first (Ut) and second (Uh) operating voltages to an ionization measurement chamber which includes a source of ionizing radiation and which is connected, in series with a load resistor, between first and second voltage supply lines, the first operating voltage being less than the second operating voltage, amplifying output signals from the ionization measurement chamber corresponding to the first and second operating voltages, thereby defining first and second amplified signals respectively, and producing an alarm signal when the first amplified signal divided by a first quiescent-state voltage (Ua) is less than an alarm threshold voltage (Us1) and the first amplified signal divided by the first quiescent-state voltage is less than the second amplified signal divided by a second quiescent-state voltage (Ub).

11. The method of claim 10, comprising the production of a trouble signal when the first amplified signal divided by a first quiescent-state voltage is greater than the second amplified signal divided by a second quiescent state voltage, and less than a monitoring threshold value (Us2).

* * * * *

UNITED STATES PATENT AND TRADEMARK OFFICE

CERTIFICATE OF CORRECTION

PATENT NO. : 5,243,330

DATED : September 7, 1993

INVENTOR(S) : Marc Thuillard

It is certified that error appears in the above-identified patent and that said Letters Patent is hereby corrected as shown below:

Col. 9, line 14, "first detector" should read --fire detector--.

Signed and Sealed this

Twelfth Day of July, 1994

Bruce Lehman

*Attest:*

BRUCE LEHMAN

*Attesting Officer*

*Commissioner of Patents and Trademarks*